United States Patent [19]

Dickinson

[11] 4,158,514

[45] Jun. 19, 1979

[54] SAFETY TRAFFIC CONTROLLER

[76] Inventor: Harry D. Dickinson, 1681 Larco Way, Glendale, Calif. 91202

[21] Appl. No.: 916,207

[22] Filed: Jun. 16, 1978

[51] Int. Cl.[2] ..... E01F 13/00

[52] U.S. Cl. ..... 404/6

[58] Field of Search ..... 404/6, 9, 10, 11; 49/49

[56] References Cited

U.S. PATENT DOCUMENTS

| | | | |
|---|---|---|---|
| 1,662,298 | 3/1928 | Corey | 404/11 |
| 1,903,739 | 4/1933 | Tatlock | 404/11 |
| 2,176,285 | 10/1939 | Whiting | 404/11 |
| 2,762,145 | 9/1956 | Rupe | 49/49 |
| 2,918,740 | 12/1959 | Smith | 49/49 |
| 3,783,558 | 1/1974 | Keator | 49/49 |
| 3,805,448 | 4/1974 | Carr | 49/49 |
| 4,016,679 | 4/1977 | Ellefson | 49/49 |
| 4,097,170 | 6/1978 | Dickenson | 404/6 |

*Primary Examiner*—Nile C. Byers, Jr.
*Attorney, Agent, or Firm*—William H. Maxwell

[57] ABSTRACT

A visible traffic controller permitting one-way and preventing wrong-way flow of vehicle traffic, and including a safety feature for the prevention of serious bodily injury to persons who might accidentally encounter the same, and comprising retractile barrier blades operated to functional position by noninjurious levers raised by soft spring action to be encountered by a vehicle tire in both the one-way and wrong-way directions of flow, and operable by a vehicle moving in the later direction to damage its tires.

44 Claims, 11 Drawing Figures

SAFETY TRAFFIC CONTROLLER

BACKGROUND

Traffic controllers are utilized as intimidating devices that preclude wrong-way traffic of automobiles at the entrances and exits of parking areas and the like. That is, a visible barrier is presented at the pavement level so as to permit the desired traffic flow by means of its depression when engaged by rolling tires, and so as to cause or likely to cause tire damage to undesired reverse flow traffic by means of its visible configuration of projecting members. In practice, notice in the form of warning signs is posted so as to advise motorists and pedestrians as well of the consequences to expect in attempting to defeat the barrier; that is, that danger exists and the probability of tire damage when a motorist persists in violating the barrier to ingress or egress established by a proprietor.

Heretofore, traffic directors or controllers of the type under consideration have involved retractile spring arms and spikes assembled as a unit in a frame above or inset into an excavation below the pavement level. Although such controllers are entirely satisfactory as related to vehicular traffic, they can be dangerous with respect to pedestrian traffic, even though trespass may be involved. For example, a trespassing pedestrian might unwittingly stumble upon said spikes, fall, and be impaled thereon. Obviously, injury may befall the unwary intruder, raising the question of liability and responsibility of the property owner to have avoided such an accident. Accordingly, it is an object of this invention to provide a traffic controller of the type under consideration which is effective and yet safe with respect to pedestrians who might unwittingly stumble thereon.

The traffic controllers with which this invention is concerned permit one-way traffic and preclude wrong-way traffic of pneumatic tired vehicles. That is, said one-way traffic rolls thereover without harm while said wrong-way traffic encounters a damaging spiked barrier. Significantly however, said spike barrier is ever present and exposed in the prior art devices depressible only in the wrong-way mode, the spiked barrier being depressible against rather heavy springs. Accordingly, the spiked barrier may easily be depressed by the weight of a vehicle, but not so by the body or member of a person falling thereupon. To this end it is an object of this invention to provide a spiked barrier that is normally retracted and which rises to its function only during a wrong-way encounter with a vehicle wheel. It is another object to provide lever means raised by light spring pressure and engageable with a vehicle wheel to raise the spiked barrier, a feature being the normal exposure of said lever means and its noninjurious and non-damaging configuration easily depressed against said light spring pressure.

Traffic controllers have been installed both above and below grade, below grade installations being most common where a recess or well structure is permitted. However, recessed installations are often prohibited, as they are in structures that have prestressed slabs of pavement, in that box-shaped recesses present interruptions that break through membranes and weaken said structures. Accordingly, it is an object of this invention to provide a generic concept that is adaptable in at least two species applicable to below grade and above grade installations respectively. Generally, the spiked barrier is characterized by barrier blades that are normally retracted and raised by lever means associated therewith and that normally project for tire engagement. Specifically, the below grade installation is characterized by integral blade and lever units, and the above grade installation is characterized by separate blade and lever units; all as hereinafter described.

SUMMARY OF INVENTION

This invention relates to traffic controllers of the type presenting a visible barrier that is engageable by the tires of a vehicle rolling over or into the same. The barrier is comprised of a transverse series of barrier blades projecting radially from trunnions upon which they revolve between retracted and extended positions. Note particularly that the blades are movably retracted. The barrier blades are heavily spring biased to said retracted position from which they are extensible by means of a lever lightly spring biased to an upright position and operated to raise the barrier blade by a tire rolling thereover in said wrong-way direction only. However, both the barrier blade and lever means are retracted by a tire rolling thereover in said one-way direction only. The blades have points elevated by tire engagement with the lever means rotating said wrong-way to engage the tire periphery at a substantially normal angle adapted to pierce the same.

DRAWINGS

The various objects and features of this invention will be fully understood from the following detailed description of the typical preferred forms and applications thereof, throughout which description reference is made to the accompanying drawings, in which.

PREFERRED EMBODIMENT

Figure 1:
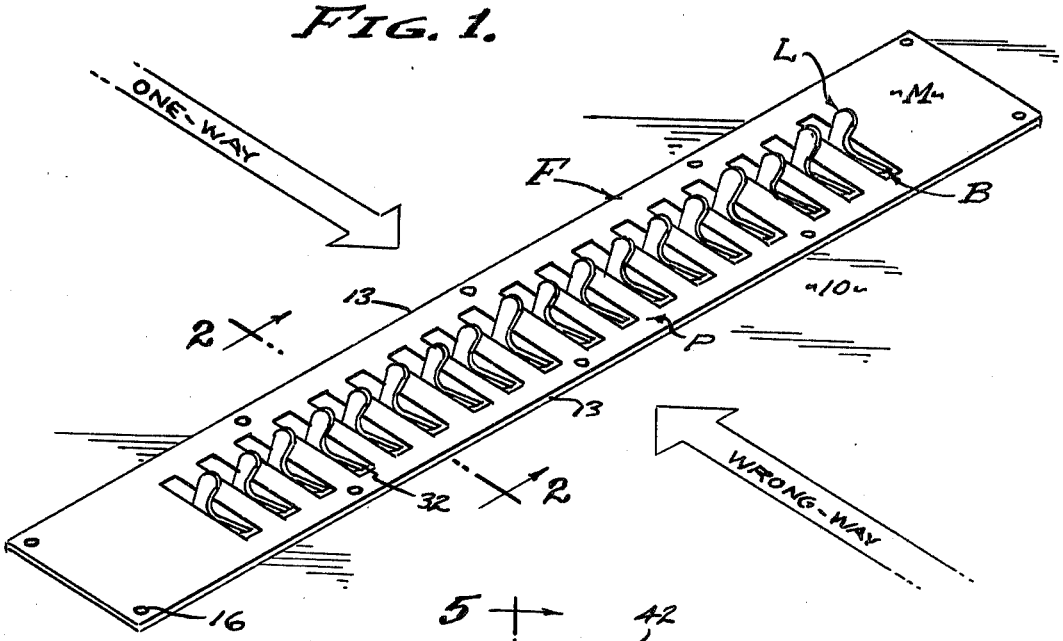
FIG. 1 is a perspective view of the safety traffic controller, the below grade form thereof.
Figure 2:
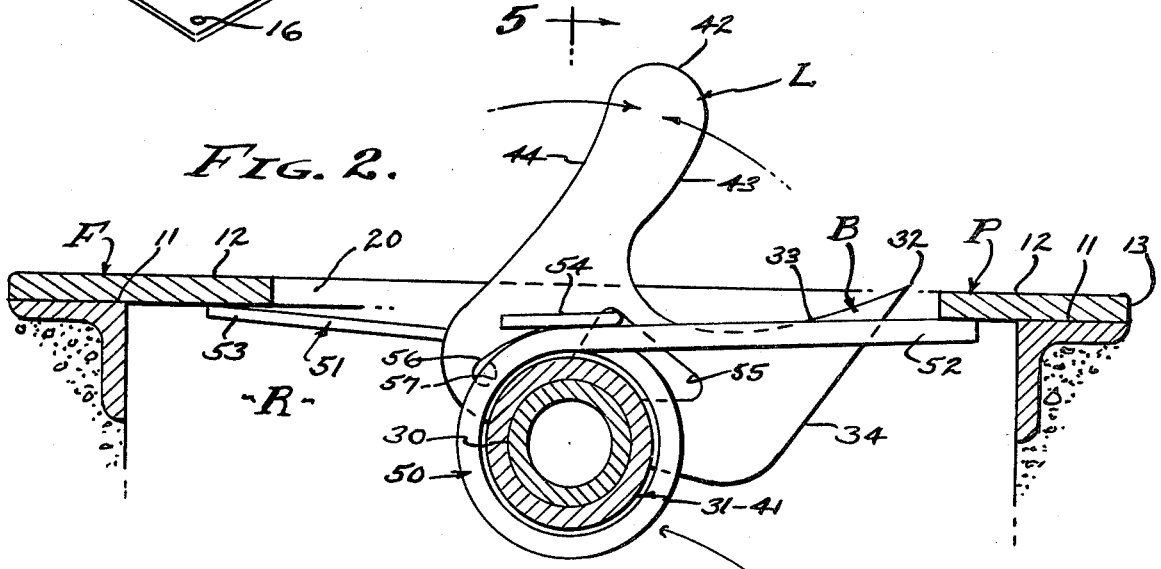
FIG. 2 is an enlarged sectional view taken as indicated by line 2—2 on FIG. 1, illustrating the normal position of the operating lever.

Referring now to the drawings, the low profile modular traffic controller of the present invention is adapted for transverse installation across a vehicular driveway or the like, to freely pass vehicle traffic moving in the one-way direction and to preclude wrong-way traffic moving in the wrong-way direction. The traffic controller is an elongated structural unit burried in or superimposed over a flat pavement slab 10 to extend transversely of the driveway (not shown) and normal to the direction of traffic flow in either direction.

In accordance with this invention, the frame F is a ramped-channel member (flat or inclined) several feet wide and with spaced and parallel rails 11 to which ramps 12 extend from the opposite margins 13 of a base. The rails 11 establish the height of the channel defined thereby to open upwardly. In practice, the ramps 12 and base members are planar sheet or plate steel of rectangular configurations, and the rise for the opposite inclined planes is established by the top flange or spacer over the rail members 11 as shown. A feature is the horizontally coplanar top surface of the rails 11 that carry the ramps 12, and all of which is integrally welded along the edges of joinder. In practice, the rails are parallel and spaced ten inches to the outside thereof respectively. Fastener openings 15 are spaced along the margins 13 for the reception of hold-down fasteners 16, and adhesive being used between the base and pavement surface for securement, all as circumstances require. It will be seen that the frame F is essentially the same for both forms of the invention as disclosed herein.

A plurality of barrier modules M are employed in adjacent relationship for support by the frame and/or support F, and to present the barrier blades B in a uniform series spaced longitudinally thereof. It is to be understood that a single transverse module can be employed. A feature of this invention is that the barrier modules are alike and preferably identical so as to be replaceably interchangeable and reversible as well. Another feature is the presentation of a plurality of barrier blades B by each barrier module M, for example a group of three blades equally spaced with respect to each other and also with respect to the blades of next adjacent barrier modules.

Each barrier module M comprises a rectangular mounting plate P of normally ten inch width to span the coplanar flanges of the two rails 11 and of one foot length in which case there is a center barrier blade B with two side barrier blades B spaced four inches therefrom. Accordingly, the mounting plate P has opposite edges 18 and ends 19, and slotted openings normal to the edges 18 at 20, 20' and 20" to receive the three sets of blades and levers with side and end (point) clearance. Each free edge portion of the mounting plate, between the slots and opposite parallel ends thereof is notched at 22 for the reception of a fastener 23, and the opposite parallel edge 18 with a pair of notches 24 complementary to the central pair of notches 22; for reversible securement to the rails 11 respectively. Accordingly, there is a frame or support station for each barrier module M to be mounted thereon, and each station has a fastener hole pattern in the rails 11 to accommodate the wide and narrow spacing of said notches 22 and 24, or rectangular hole pattern, as the case may be. That is, there is a uniformly repeated hole pattern in the rails 11 to secure the fasteners 23 at opposite sides of the mounting plate P.

Spaced trunnions T are provided on an axis of rotation between opposite edges 18, there being trunnion openings in transverse frame members F or depending from the margin of the plate P at each opposite end 19 of the mounting plate P (compare the two forms). As shown in the below grade form, the pair of trunnions are openings 27 and 28 in frame bulkheads. As shown in the above grade form, the pair of trunnions are of boss configuration removably screw fastened to the plate P and they present opposed faces 25 and 26 normal to said axis and normal to the plane of plate P. A feature is the pair of openings 27 and 28 disposed on said axis of rotation closely spaced, as shown, below the underside 29 of the said plate. In practice, the base plate or member 14 and mounting plate P are one-quarter inch thick.

Referring now to the several barrier blades B that are journaled in the trunnions T to operate independently in side by side relation, there is a mounting shaft or tube 30 upon which the several blades and levers are rotatably carried as unit assemblies. As shown, the mounting tube 30 is a shaft of right cylinder form with its opposite projecting end portions supportably fixed in the journal openings 27 and 28 respectively. The barrier blades and lever assemblies are identical unit assemblies that are independently functional as will now be described.

The blade B is carried by a sleeve portion 31 that revolves freely upon the support tube 30 and projects radially therefrom to a point 32. In practice, the blade is three-eights inch thick of triangular form with its point disposed toward the wrong-way; in opposition to a vehicle moving in said wrong-way direction. In carrying out this invention, the point 32 is nominally four inches from the rotative center with an included angle of 32°, more or less, and adapted to extend approximately two and one half inches above the plate P. The inside face 33 of the blade is substantially coincidental at point 32 with a line drawn through the center of rotation, namely the axis of sleeve portion 31. The outside face 34 of the blade turns inward to the sleeve portion 31 at its base normal to said axis thereof.

The lever L is carried by a sleeve portion 41 that revolves freely upon the support tube 30 and projects radially therefrom to a blunted end 42. In practice, the lever is three eights inch thick of rounded noninjurious configuration or finger-formed disposed toward the one-way; in opposition to a vehicle moving in said one-way direction. In carrying out this invention, the blunted end 42 is nominally four inches from the rotative center with a roundness of approximately one inch, and adapted to extend approximately two and one half inches above the plate P. The inside face 43 of the lever is substantially coincidental with a line drawn through the center of rotation, namely the axis of sleeve portion 41. The outside face 44 of the lever turns inward to the sleeve portion 41 at its base normal to said axis thereof. As shown, the lever is finger-shaped with the noninjurious blunted end 42 somewhat enlarged.

Figure 3:
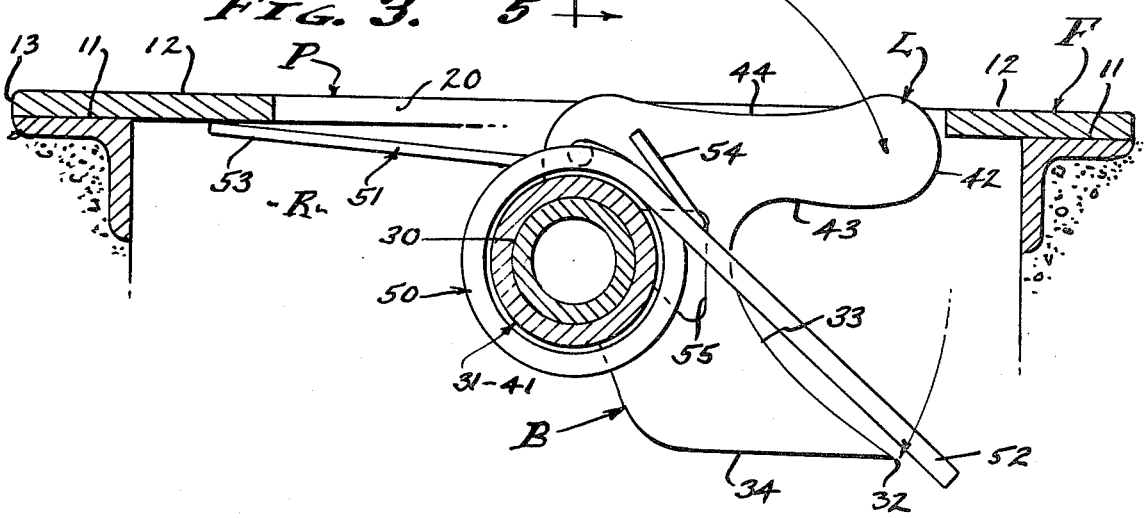
FIG. 3 is a view similar to FIG. 2, illustrating the depressed position of the operating lever.
Figure 4:
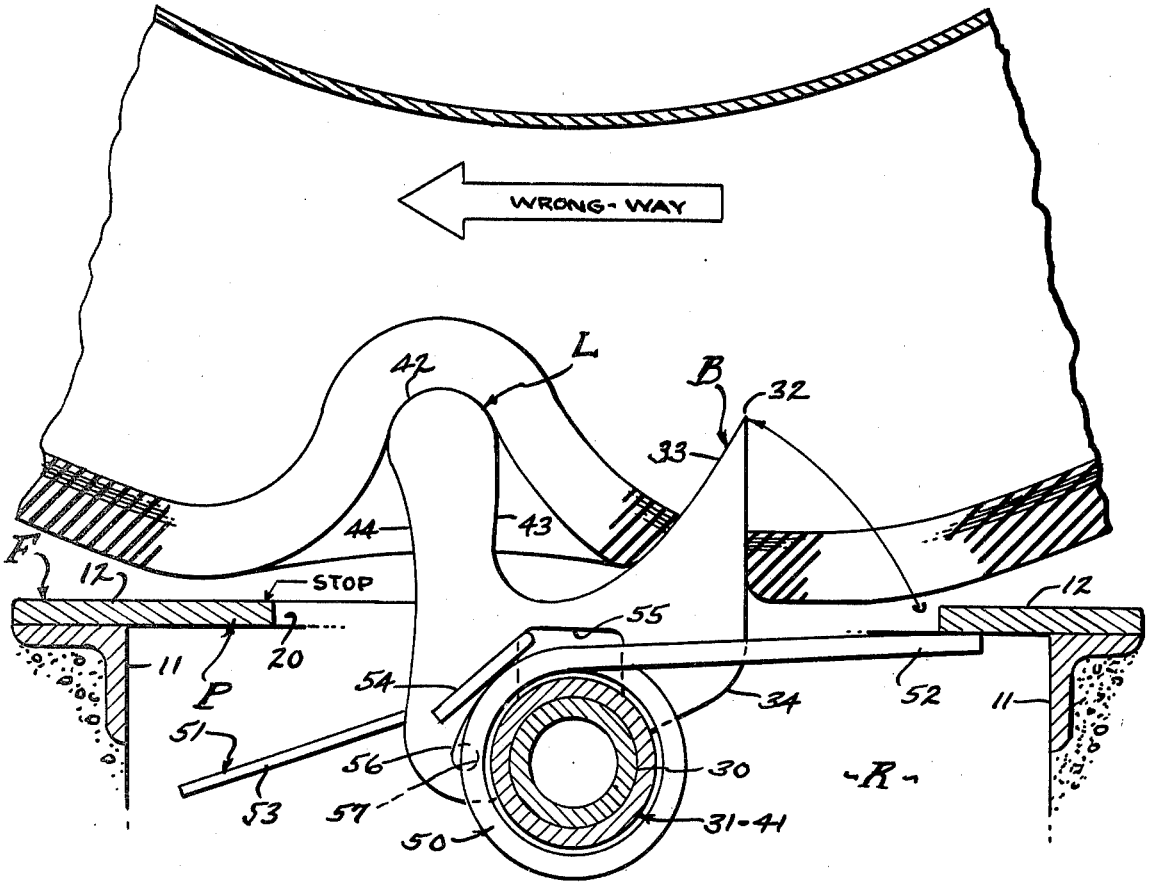
FIG. 4 is a view similar to FIGS. 2 and 3, illustrating the operation to pierce a tire.
Figure 5:
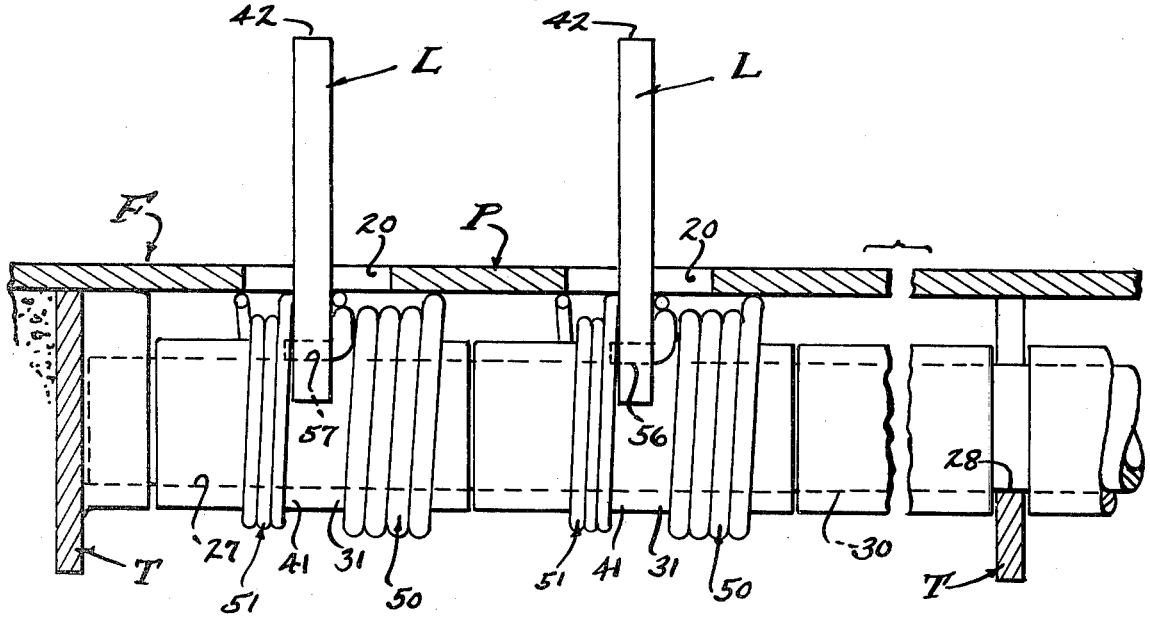
FIG. 5 is a fragmentary sectional view taken as indicated by line 5—5 on FIG. 2.
Figure 6:
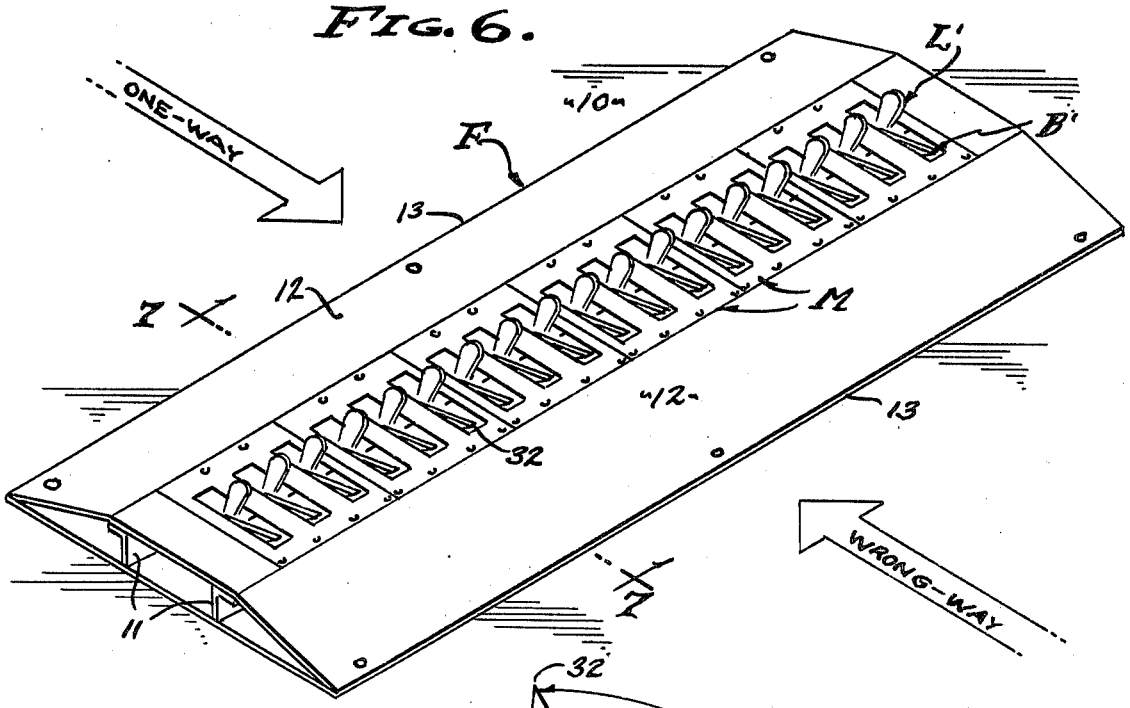
FIG. 6 is a perspective view of the safety traffic controller, the above grade form thereof.
Figure 7:
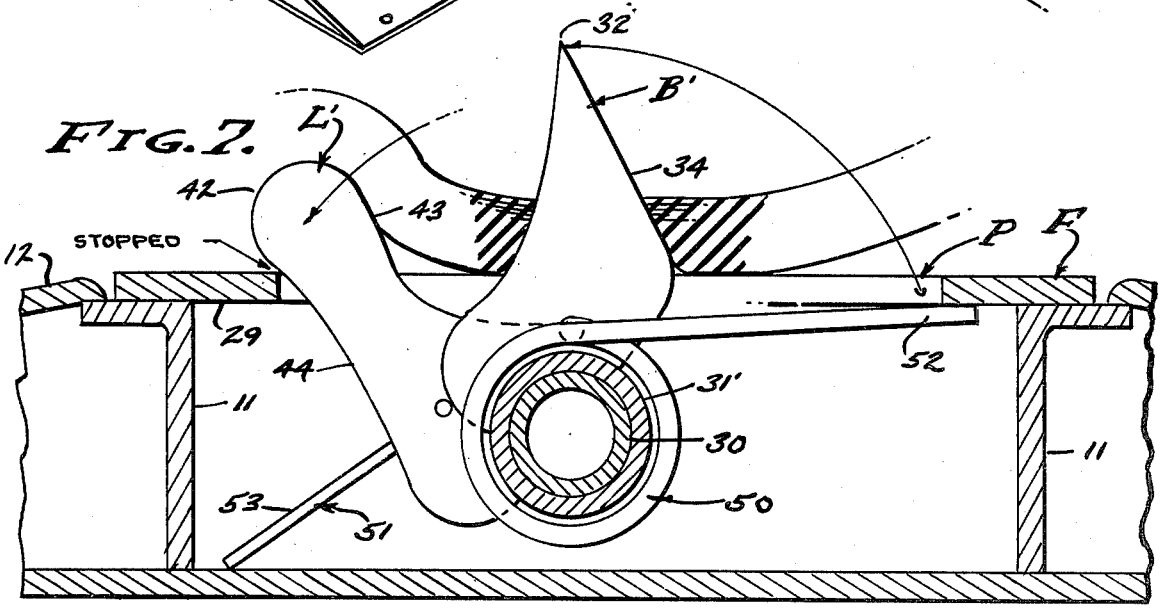
FIG. 7 is an enlarged sectional view taken as indicated by line 7—7 on FIG. 6, illustrating the operation to pierce a tire.
Figure 8:
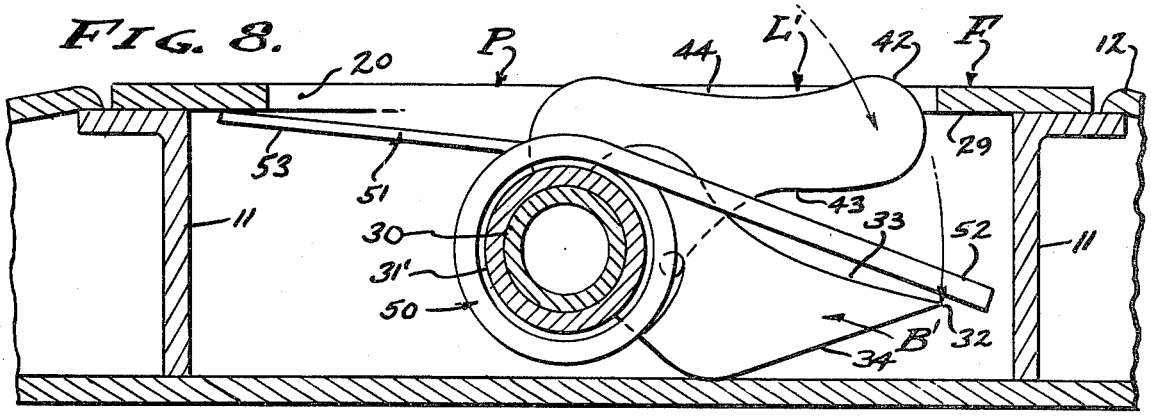
FIG. 8 is a view similar to FIG. 7, illustrating the depressed position of the operating lever.
Figure 10:
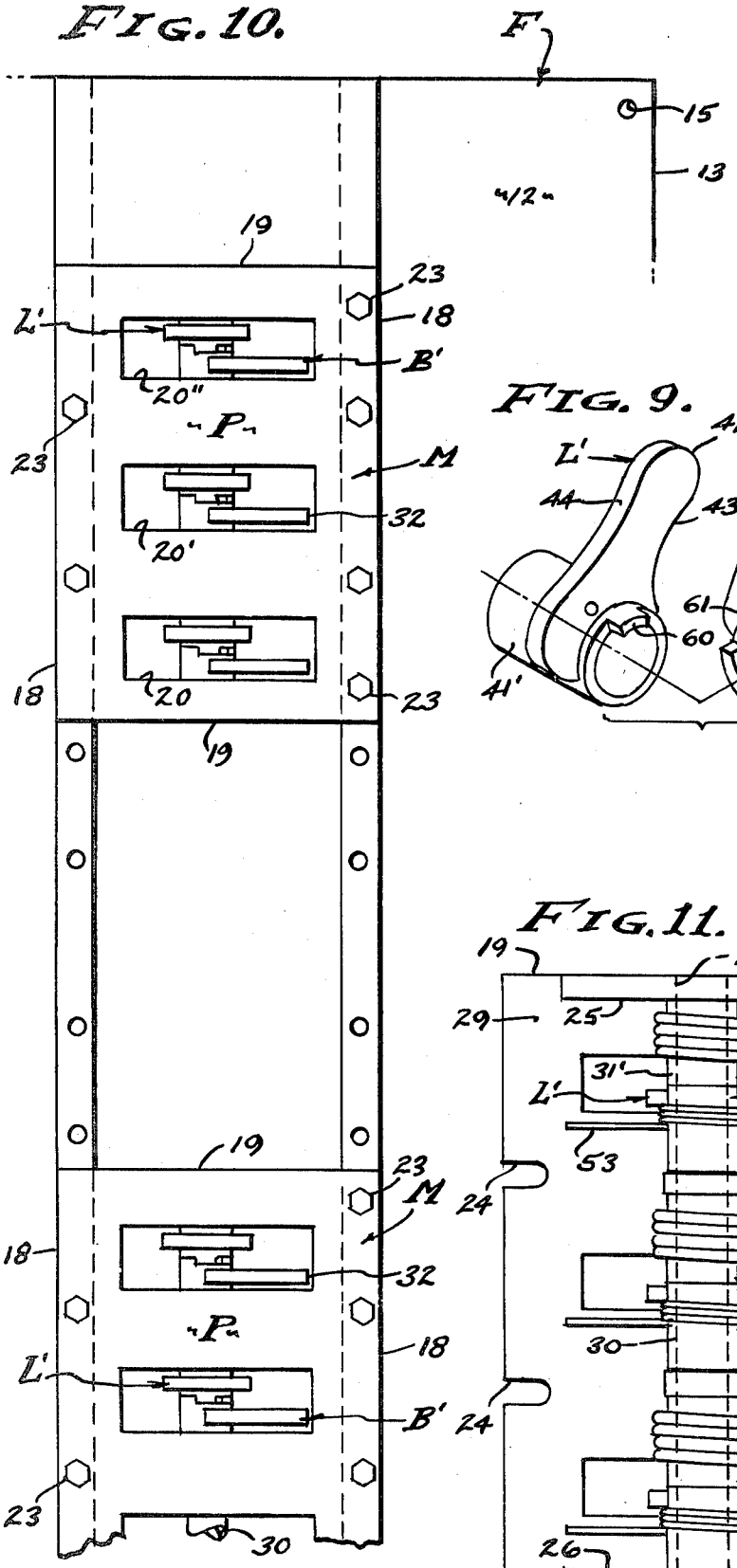
FIG. 10 is a plan view of a portion of the controller shown in FIG. 6, with one of said modules removed therefrom.
Figure 9:
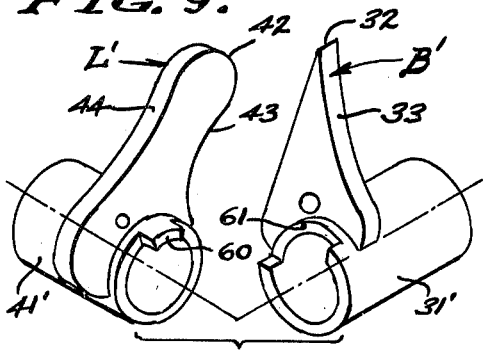
FIG. 9 is an exploded perspective view of the separate barrier blade and operating lever therefor, illustrating the lost motion therebetween.
Figure 11:
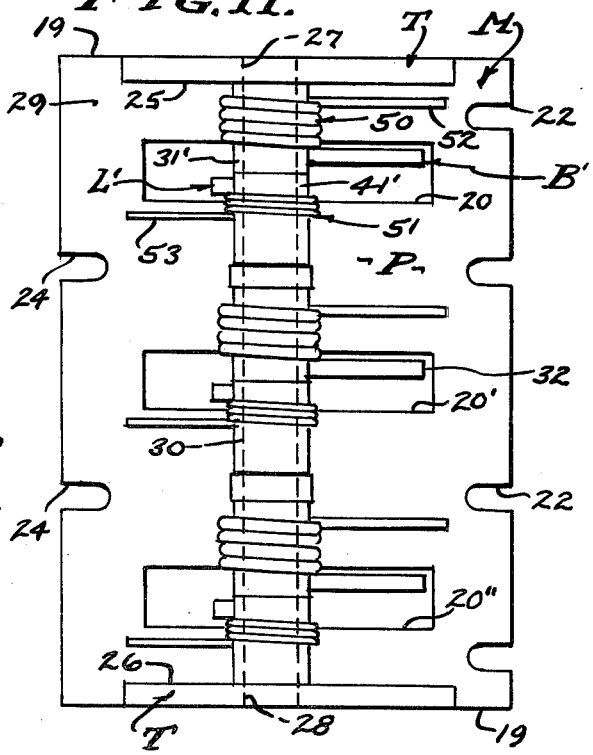
FIG. 11 is a bottom view of one of the modules, enlarged and taken separately from the assembly shown in FIG. 10.

Referring now to the first form of this invention as it is illustrated in FIGS. 1 to 5, the installation thereof is below grade, partially at least. In this form there is a recess R in the pavement 10 to accommodate the lowermost rotative position of the blades B and levers L respectively. The basic concept involves the depression of lever L to the surface of plate P by means of either one-way or wrong-way rotation, and the raising of the barrier blade B by means of wrong-way rotation of the lever L. A characteristic feature is that the lever L is normally upright and is adapted to depress either in the one-way or the wrong-way direction (compare FIGS. 3 and 4). In accordance with the form now under consideration, the blade B and lever L are integral and the sleeve portions 31 and 41 made as a single tubular member, the four inch extremities of the blade and lever being angularly separated approximately 55° and the point 32 and end 42 separated about three and one half inches. The proportions of parts and elements is significant, and it will be observed that the lever L is normally pitched 15° from the one-way direction when the blade point 32 is at the plane of plate P. Said 15° pitch and lift of the lever arm as above described has a definite relationship to the radius of the pneumatic tire to be punctured, namely a tire having a ten to thirteen inch radius (or slightly larger). As shown in FIG. 3 the blade B depends into recess R when the lever L is flush with the plate P. However, rotation of the integral blade B and lever L in the wrong-way direction as caused by rolling engagement of a tire thereon causes the blade B to be raised as it is shown in FIG. 4; to puncture the tire. It is to be observed that the lever when rotated in the wrong-way direction is stopped by the frame F or plate P, so as to lock the blade B in its functional position to damage the tire. The parts and elements are proportioned herein to function properly with tires twenty to twenty-six inches in outside diameter (or slightly larger), the said 15° pitch of the lever L facilitating depression in the one-way direction while assuring two points of engagement with the tire during wrong-way motion.

The normal positioning of the barrier blade B and lever L is established by the extended positions of two oppositely acting springs, each acting as a yielding stop. In practice, there is a coil spring surrounding the sleeve portions 31 and 41 at each side of the plate material forming the integral blade and lever. The blade stop spring 50 is the stronger as it resists raising of the damaging point 32, while the lever stop spring 51 is the weaker as it resists one-way movement of the lever. The springs have anchors secured to the sleeve and are wound in opposite directions with straight tangential tongues 52 and 53 engaged beneath the plate P. The spring anchorage is unique in this integral blade and lever form of the invention, one spring anchor being locked in working position by the other. One spring, preferably the weaker lever stop spring 51 has a loop 54 entered through a circumferential slot 55 in the plate forming said integral blade and lever, and in which it is seated against the one-way rotation thereof and spaced radially from the sleeve portion 31 or 41, as the case may be. The other spring, the stronger blade stop spring 50 has a normal end 56 entered into an opening 57 in said plate, spaced circumferentially from slot 55 so that the anchor end portion of spring 50 underlies the loop end of spring 51. In practice, the normal end of spring 51 is jammed into opening 57 and beneath the terminal end portion of loop 54, thereby jointly locking the anchored ends of the springs. As shown, the springs 50 and 51 are straight oppositely wound torsion springs with extended tongues to anchor the same. The initial bias afforded by the two springs is light, whereby the lever L is normally upstanding to be visibly obtrusive, and the blade point 32 retracted for safety.

Referring now to the second form of this invention as it is illustrated in FIGS. 6 to 11, the installation thereof is above grade, totally. In this form the base is superimposed upon the slab 10 without interruption of the slab surface. Accordingly, the blade B′ member is not permitted to rotate into a depending position as above described but is restricted to retract only to a horizontally disposed position. However, the lever L′ operates the same as in the first form, between an upright position and a depressed position lying substantially horizontal. In accordance with the form now under consideration, the blades B′ and levers L′ are separate parts carried upon the independently rotatable sleeve portions 31′ and 41′ that remain separate tubular members. Otherwise the proportions and relationship of the blade B′ and lever L′ remain the same as hereinabove described with reference to blade B and lever L, that is when they are normally positioned with the blade point 32 depressed to the level of plate P and with the lever L raised into upright position pitched toward the wrong-way direction. The normal upright position of lever L′ is established by lost motion engagement with blade B′ and by the lever stop spring 51 with its tongue 53 stopped by the underside 29 of plate P (see FIG. 8). The normal retracted position of the blade B′ is established by the blade stop spring 50 with its tongue 52 stopped by the underside 29 of plate P (see FIG. 7) and the blade point 32 movable from the plate P as indicated. A feature is the lost motion between the blade and lever, the lever L′ being free to rotate in the one-way direction without movement of the blade B′, and the lever L′ being engageable with the blade B′ to rotate it in the wrong-way direction from the normal upright position. As shown, a drive lug 60 projects from one sleeve portion 41′ to engage in a drive opening 61 of greater circumferential extent in the other sleeve portion 31′. It will be apparent how the blade B′ raises with the lever L′ when rotated in the wrong-way direction, while the lost motion allows movement of the lever L′ in the one-way direction of rotation without affecting movement of blade B′. The blade B′ and lever L′ are arranged side by side so as not to interfere one with the other, as shown.

Having described only typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A vehicle traffic controller permitting traffic flow in a one-way direction while preventing traffic flow in an opposite wrong-way direction, and including:

a support to be transversely installed on a pavement surface over which vehicular traffic is to pass and comprising, a pair of spaced rails secured to said pavement surface, there being an upwardly open channel between said secured rails;

a slotted plate secured to and extending between the rails;

a mounting shaft disposed transversely beneath said slotted plate;

a plurality of barrier blades in a series along said mounting shaft and rotatively carried thereby, said barrier blades being normally retracted into the slots of the plate respectively;

a plurality of levers and one for each barrier blade and rotatively carried along said mounting shaft, said levers being normally extended from the slots of the plate and rotatively depressible in both the one-way and wrong-way direction;

spring means yieldingly urging the barrier blades and levers to their respective normal positions;

and means responsive to wrong-way rotation of the levers to rotate the barrier blades therewith and upward from the slotted plate, when encountering a wrong-way vehicle tire to damage the same.

2. The traffic controller as set forth in claim 1, wherein each barrier blade has a point disposed radially from said mounting shaft about which it rotates.

3. The traffic controller as set forth in claim 1, wherein each lever has a blunted end disposed radially from said mounting shaft about which it rotates.

4. The traffic controller as set forth in claim 1, wherein complementary barrier blades and levers are angularly displaced in their said normal positions respectively.

5. The traffic controller as set forth in claim 1, wherein complementary barrier blades and levers are of substantially equal radius.

6. The traffic controller as set forth in claim 1, wherein complementary barrier blades and levers are of substantially equal radius and angularly displaced in their said normal positions respectively.

7. The traffic controller as set forth in claim 1, wherein each barrier blade has a point disposed radially from said mounting shaft about which it rotates, and wherein each lever has a blunted end disposed radially from said mounting shaft about which it rotates.

8. The traffic controller as set forth in claim 1, wherein each barrier blade has a point disposed radially from said mounting shaft about which it rotates, wherein each lever has a blunted end disposed radially from said mounting shaft about which it rotates, and wherein the said point of each barrier blade is held angularly displaced from the blunted end of its complementary lever stopped by said spring means.

9. The traffic controller as set forth in claim 1, wherein each barrier blade has a point disposed radially from said mounting shaft about which it rotates, wherein each lever has a blunted end disposed radially from said mounting shaft about which it rotates, and wherein the said points of the barrier blades and blunted ends of the levers are held angularly displaced by said means responsive to wrong-way rotation when moving upward therewith.

10. The traffic controller as set forth in claim 1, wherein the complementary barrier blades and levers are nominally of four inch radius from the center of rotation respectively and angularly displaced nominally 55° in their said normal positions and held thereat angularly displaced by said means responsive to wrong-way rotation.

11. The traffic controller as set forth in claim 1, wherein the said spring means comprises two oppositely acting springs, one yieldingly urging the lever to its normal position, and the other yieldingly urging the barrier blade to its normal position.

12. The traffic controller as set forth in claim 1, wherein the said spring means comprises two oppositely acting springs, one a substantially weak spring yieldingly urging the lever to its normal position, and the other a substantially strong spring yieldingly urging the barrier blade to its normal position.

13. The traffic controller as set forth in claim 1, wherein the said spring means comprises two oppositely wound torsion springs, one surrounding the mounting shaft at the side of and yieldingly urging the lever to its normal position, and the other surrounding the mounting shaft at the side of and yieldingly urging the barrier blade to its normal position.

14. The traffic controller as set forth in claim 1, wherein the said spring means comprises two oppositely wound torsion springs, one a substantially weak spring surrounding the mounting shaft at the side of and yieldingly urging the lever to its normal position, and the other a substantially strong spring surrounding the mounting shaft at the side of and yieldingly urging the barrier blade to its normal position.

15. A below grade traffic controller permitting traffic flow in a one-way direction while preventing traffic flow in an opposite wrong-way direction, and including:

a support to be installed on a pavement surface over a recess therein extending transversely thereof and over which vehicular traffic is to pass and comprising, a pair of spaced rails embracing said recess and secured to said pavement surface, there being an upwardly open channel defined by said rails and recess;

a slotted plate secured to and extending between the rails;

a mounting shaft disposed transversely beneath said slotted plate;

a plurality of barrier blade and lever units integrally secured to individual sleeve members rotatively carried along said mounting shaft, said barrier blades being normally retracted into the slots of the plate respectively, and said levers being normally extended from the slots of the plates and rotatively depressible in both the one-way and wrong-way direction;

and spring means yieldingly urging each blade and lever unit to said normal blade retraction and lever extention position;

wrong-way rotation of the levers rotating the barrier blades upward therewith from the slotted plate, when encountering a wrong-way vehicle tire to damage the same.

16. The traffic controller as set forth in claim 15, wherein each barrier blade has a point disposed radially from said mounting shaft about which it rotates.

17. The traffic controller as set forth in claim 15, wherein each lever has a blunted end disposed radially from said mounting shaft about which it rotates.

18. The traffic controller as set forth in claim 15, wherein complementary barrier blades and levers are angularly displaced in their said normal positions respectively.

19. The traffic controller as set forth in claim 15, wherein complementary barrier blades and levers are of substantially equal radius.

20. The traffic controller as set forth in claim 15, wherein complementary barrier blades and levers are of substantially equal radius and angularly displaced in their said normal positions respectively.

21. The traffic controller as set forth in claim 15, wherein each barrier blade has a point disposed radially from said mounting shaft about which it rotates, and wherein each lever has a blunted end disposed radially from said mounting shaft about which it rotates.

22. The traffic controller as set forth in claim 15, wherein each barrier blade has a point disposed radially from said mounting shaft about which it rotates, wherein each lever has a blunted end disposed radially from said mounting shaft about which it rotates, and wherein the said points of the barrier blades are held angularly displaced from the blunted ends of their complementary levers by said sleeve members.

23. The traffic controller as set forth in claim 15, wherein each barrier blade has a point disposed radially from said mounting shaft about which it rotates, wherein each lever has a blunted end disposed radially from said mounting shaft about which it rotates, and wherein the said points of the barrier blades and blunted ends of the levers are held angularly displaced by said sleeve members respectively.

24. The traffic controller as set forth in claim 15, wherein the complementary barrier blades and levers are nominally of four inch radius from the center of rotation respectively and angularly displaced nominally 55° in their said normal positions and held thereat angularly displaced by said sleeve members respectively.

25. The traffic controller as set forth in claim 15, wherein the said spring means comprises two oppositely acting springs, one yieldingly urging the lever to its normal position, and the other yieldingly urging the barrier blade to its normal position.

26. The traffic controller as set forth in claim 15, wherein the said spring means comprises two oppositely acting springs, one a substantially weak spring yieldingly urging the lever to its normal position, and the other a substantially strong spring yieldingly urging the barrier blade to its normal position.

27. The traffic controller as set forth in claim 15, wherein the said spring means comprises two oppositely wound torsion springs, one surrounding the mounting shaft at one side of each blade and lever unit and yieldingly urging the lever to its normal position, and the other surrounding the mounting shaft at the other side of each blade and lever unit and yieldingly urging the barrier blade to its normal position.

28. The traffic controller as set forth in claim 15, wherein the said spring means comprises two oppositely wound torsion springs, one a substantially weak spring surrounding the mounting shaft at one side of each blade and lever unit and yieldingly urging the lever to its normal position, and the other a substantially strong spring surrounding the mounting shaft at the other side of each blade and lever unit and yieldingly urging the barrier blade to its normal position.

29. The traffic controller as set forth in claim 15, wherein the said spring means comprises two oppositely wound torsion springs, one with a hooked end engaged in a circumferential slot in the integral blade and lever and yieldingly urging the lever to its normal position, and the other with a normal end engaged in an opening in the integral blade and lever and yieldingly urging the blade to its normal position.

30. The traffic controller as set forth in claim 15, wherein the said spring means comprises two oppositely wound torsion springs, one with a hooked end engaged and seated in opposition to one-way rotation in a circumferential slot in the integral blade and lever and yieldingly urging the lever to its normal position, and the other with a normal end engaged in an opening in the integral blade and lever in opposition to wrong-way rotation and yieldingly uring the blade to its normal position, the end of said other spring being circumferentially juxtaposed radially within the hooked end of the said one spring to lock the same in seated position in said slot.

31. An above grade traffic controller permitting traffic flow in a one-way direction while preventing traffic flow in an opposite wrong-way direction, and including:

a low profile support to be transversely superimposed upon a pavement surface over which vehicular traffic is to pass and comprising, a pair of spaced rails secured to said pavement surface, there being an upwardly open channel between said secured rails;

a slotted plate secured to and extending between the rails;

a mounting shaft disposed transversely beneath said slotted plate;

a plurality of complementary barrier blade and lever members secured to individually rotatable sleeves carried along said mounting shaft, said barrier blades being normally retracted into the slots of the plate respectively, and said levers being normally extended from the slots of the plates and rotatively depressible in both the one-way and wrong-way direction;

spring means yieldingly urging the blade and lever members to said normal blade retraction and lever extention positions respectively;

and coupling means responsive to wrong-way rotation of the levers to rotate the barrier blades therewith and upward from the slotted mounting plate, when encountering a wrong-way vehicle tire to damage the same.

32. The traffic controller as set forth in claim 31, wherein each barrier blade has a point disposed radially from said mounting shaft about which it rotates.

33. The traffic controller as set forth in claim 31, wherein each lever has a blunted end disposed radially from said mounting shaft about which it rotates.

34. The traffic controller as set forth in claim 31, wherein complementary barrier blades and levers are angularly displaced in their said normal positions respectively.

35. The traffic controller as set forth in claim 31, wherein complementary barrier blades and levers are of substantially equal radius.

36. The traffic controller as set forth in claim 31, wherein complementary barrier blades and levers are of substantially equal radius and angularly displaced in their said normal positions respectively.

37. The traffic controller as set forth in claim 31, wherein each barrier blade has a point disposed radially from said mounting shaft about which it rotates, and wherein each lever has a blunted end disposed radially from said mounting shaft about which it rotates.

38. The traffic controller as set forth in claim 31, wherein each barrier blade has a point disposed radially from said mounting shaft about which it rotates, wherein each lever has a blunted end disposed radially from said mounting shaft about which it rotates, and wherein the said point of each barrier blade is held angularly displaced from the blunted end of its complementary lever stopped by said spring means.

39. The traffic controller as set forth in claim 31, wherein each barrier blade has a point disposed radially from said mounting shaft about which it rotates, wherein each lever has a blunted end disposed radially from said mounting shaft about which it rotates, and wherein the said points of the barrier blades and blunted ends of the levers are held angularly displaced by said means responsive to wrong-way rotation when moving upward therewith.

40. The traffic controller as set forth in claim 31, wherein the complementary barrier blades and levers are nominally of four inch radius from the center of rotation respectively and angularly displaced nominally 55° in their said normal positions and held thereat angularly displaced by said means responsive to wrong-way rotation.

41. The traffic controller as set forth in claim 31, wherein the said spring means comprises two oppositely acting springs, one yieldingly urging the lever to its normal position, and the other yieldingly urging the barrier blade to its normal position.

42. The traffic controller as set forth in claim 31, wherein the said spring means comprises two oppositely acting springs, one a substantially weak spring yieldingly urging the lever to its normal position, and the other a substantially strong spring yieldingly urging the barrier blade to its normal position.

43. The traffic controller as set forth in claim 31, wherein the said spring means comprises two oppositely wound torsion springs, one surrounding the mounting shaft at the side of the yieldingly urging the lever to its normal position, and the other surrounding the mounting shaft at the side of and yieldingly urging the barrier blade to its normal position.

44. The traffic controller as set forth in claim 31, wherein the said spring means comprises two oppositely wound torsion springs, one a substantially weak spring surrounding the mounting shaft at the side of the yieldingly urging the lever to its normal position, and the other a substantially strong spring surrounding the mounting shaft at the side of and yieldingly urging the barrier blade to its normal position.

* * * * *